United States Patent [19]

Clauss et al.

[11] 4,452,596

[45] Jun. 5, 1984

[54] APPARATUS FOR MAKING CUP OF SURFACE PROTECTED PAPERBOARD

[75] Inventors: Gerhard Clauss, Donzdorf; Berthold Müller, Salach, both of Fed. Rep. of Germany

[73] Assignee: Michael Horauf Maschinenfabrik, Fed. Rep. of Germany

[21] Appl. No.: 420,881

[22] Filed: Sep. 21, 1982

Related U.S. Application Data

[63] Continuation of Ser. No. 274,174, Jun. 6, 1981, abandoned.

[30] Foreign Application Priority Data

Jun. 28, 1980 [DE] Fed. Rep. of Germany ..... 3024407

[51] Int. Cl.[3] ..... B31C 7/06

[52] U.S. Cl. ..... 493/107; 493/133; 493/155; 493/296

[58] Field of Search ..... 493/107–105, 493/116, 115, 296, 297, 108, 109, 102, 104, 155, 305, 303, 129, 133, 388, 383, 347

[56] References Cited

U.S. PATENT DOCUMENTS

| | | | |
|---|---|---|---|
| 1,439,606 | 12/1922 | Coates | 493/303 |
| 2,275,157 | 3/1942 | Morgan | 493/109 X |
| 3,439,590 | 4/1969 | Rosenberg et al. | 493/107 |
| 3,505,933 | 4/1970 | Schmidt | 493/296 |
| 3,979,048 | 9/1976 | Stark et al. | 229/48 T |
| 4,187,768 | 2/1980 | Suzuki | 493/109 |

FOREIGN PATENT DOCUMENTS

| | | | |
|---|---|---|---|
| 450020 | 6/1948 | Canada | 493/109 |

*Primary Examiner*—James F. Coan

*Attorney, Agent, or Firm*—Antonelli, Terry & Wands

[57] ABSTRACT

A paper cup of surface-protected paperboard and an apparatus for making the same, with the paper cup including a wound cup wall and a cup bottom inserted therein. Ends of a wall blank forming the cup wall are overlapped after a winding of the wall blank, and an inner cutting edge is covered by a protective strip welded together with the cup wall. The protective strip is fashioned as a sealing strip in flat contact with the inner surface of the cup wall and is welded to the cup wall on both sides of the overlapping point. The apparatus includes a winding station wherein the wall blank is wrapped onto a winding mandrel and is welded together at the overlapping zone in a subsequent welding station. With further devices being provided for inserting a cup bottom in the thus manufactured cup wall. A positioning device for the sealing strip is associated with the winding mandrel with the positioning device lying in front or preceding the winding station.

13 Claims, 6 Drawing Figures

28
17
7
2

49
48
25
27b
33
7b
27
13
18
D
31
14
10
A
30
16
29
12
9
2
32
C
50
11
26
24
20
15
B
22
7a
19

APPARATUS FOR MAKING CUP OF SURFACE PROTECTED PAPERBOARD

This is a continuation of application Ser. No. 274,174, filed June 16, 1981, and now abandoned.

The present invention relates to a cup and, more particularly, to a cup of a surface protected paperboard and an apparatus for making the same, with the cup being formed of a wound cup wall and a cup bottom inserted therein, with ends of a wall blank forming the cup wall overlapping after the winding step thereby defining an inner cutting edge which is covered by a protective strip welded together with the cup wall.

Paper cups of the aforementioned type may be produced from blanks such as, for example, described in Offenlegungsschrift 2,102,001, wherein a separate strip is provided as an edge protection for the inner open cutting edge, with the separate strip being formed of a flexible, impermeable, and heat-resistant material and being placed around the edge to be protected and firmly joined with both surfaces of the blank material constituting the cutting edge. By virtue of the provision of a separate strip, a liquid or greasy content of the cup cannot penetrate into the paper through the cutting edge since, without the protective measure afforded by the strip, the cutting edge would be pervious resulting in a soaking of the paper. The remaining inner wall surfaces are impervious or liquid tight due to the provision of a coated material and so is the bottom of the cup which is bent downwardly along its rim so that no open cutting edges remain after the sealing or welding.

A disadvantage of a cup produced with blanks such as proposed in the above-noted Offenlegungsschrift resides in the fact that a material having a relatively large wall thickness such as, for example, an aluminum foil substrate is utilized therein as the support material so as to prevent a shrinking during a sealing step. If the bilaterally coated support wall is placed around the cutting edge of the cup wall, the wall thickness is doubled at a location of the cup wall where there is already an overlapping of the ends of the blank of the cup wall. Consequently, such proposed cups exhibit a disadvantage of a unilateral thickened portion in the overlapping zone.

A further disadvantage of the above-noted cup construction resides in the fact that first all of the sealing strip placed around the open cutting edge must be sealed together with the wall blank, and such sealing step must then be followed by an actual welding operation for the two ends of the wall blank thereby resulting in the manufacturing of such cups being relativley expensive.

In order to avoid the above-noted disadvantages, other cups have been proposed such as, for example, disclosed in Offenlegungsschrift 2,540,046, wherein the open cutting edge is sealed by applying a specific sealing compound to the edge. While this proposed arrangement has proven itself under actual practical conditions, it poses relatively high requirements regarding the manufacturing process since the spot-like application of the sealing compound may only cover the lateral edge. Consequently, a flawless alignment of the blank edges is required. Therefore, it has been impossible to utilize this process in situations wherein a subsequent filler material for the cup contains fruit acid or latic acid. Moreover, it has previously been impossible to find a suitable sealing compound for such cup fillings which could be applied by a spot application method.

The aim underlying the present invention essentially resides in providing a paper cup construction of the aforementioned type as well as an apparatus for producing the same wherein the local thickened portions of the cup wall are avoided and a range of useage of the cup is not limited to specific filling media.

In accordance with advantageous features of the present invention, a protective strip is provided which is fashioned as a sealing strip and is arranged in flat contact with an inner surface of the cup wall and welded on both sides of the overlapping zone to the cup wall. By virtue of the fact that the sealing strip is no longer placed around the cutting edge, an increase in thickness by an amount of one wall thickness of the sealing strip is eliminated in the overlapping zone. Moreover, it is possible to combine the welding step for joining the sealing strip to the cup wall and the welding step for joining the two ends to the wall blank, which latter welding step is necessary anyway. Consequently, with the construction of the present invention, it is possible to save or eliminate one working step. A further advantage of the type of inner sealing of the cutting edge proposed by the present invention resides in the fact that a relatively thin sealing strip can be employed. Moreover, a heat transfer during the sealing or welding procedure is improved due to the total lower wall thickness of the overlapping joint or zone.

In accordance with advantageous features of the apparatus for making the cup of the present invention, the cutout wall blank may be wound, in a conventional manner, in a winding station onto a winding mandrel and then welded or sealed along the overlapping zone in a subsequent welding or sealing station. Means are then provided for inserting a cup bottom in the thus manufactured wound cup shell, if the winding mandrel is correlated with a positioning device for a sealing strip, arranged upstream of the winding step.

By virtue of the above-noted features of the present invention, it is possible in a very simple manner to simultaneously effect with the winding and welding or sealing step for the wall blank which is necessary any way also a sealing of the inner cutting edge. For this purpose, it is merely necessary to position the sealing strip on the winding mandrel in such a manner that it lies at a subsequently produced overlapping zone. The positioning means may simply consist of a swivel arm provided with a suction cup, with a path of motion of the swivel arm being approximately tangential to a surface of the winding mandrel and being disposed at a location where the overlapping zone of the wall blank will be disposed during the subsequent winding step.

In order to maintain the sealing strip on the winding mandrel, in accordance with further features of the present invention, the winding mandrel may at least be partially hollow and fashioned with a permeable wall portion at a periphery thereof which cooperates with the suction cup of the positioning means, with a vacuum being applied to the hollow space, which vacuum is present anyway in the cup manufacturing machine. By virtue of this arrangement, the sealing strip, positioned on the winding mandrel by the swivel arm, is held very simply and tightly against the winding mandrel and thus remains in position until the wall blank is wound and welded or sealed together with the sealing strip so as to form the cup shell.

In accordance with additional advantageous features of the present invention the winding mandrel may form a portion of a conventional winding star turret, having a path of motion correlated with various stations for cup production. In this connection, the positioning means located at one point can additionally be associated with a cutting unit for severing the sealing strip sections from sheet strip unreeled from a coil so that a continuous procedure for the manufacturing of a cup is ensured.

In accordance with still further features of the present invention, the welding station for welding the sealing strip and cutting edges of the cup may be constructed for carrying out ultrasonic welding.

Accordingly, it is an object of the present invention to provide a cup of a surface protected paperboard and apparatus for making the same which avoids, by simple means shortcomings and disadvantages encountered in the prior art.

Another object of the present invention resides in providing a cup of a surface protected paperboard which minimizes a thickness of a wall of the cup within an area of the joining seam while ensuring a liquid tight seal of the seam.

Yet another object of the present invention resides in providing a cup of a surface protected paperboard which may readily accommodate a wide range of filling media.

A further object of the present invention resides in providing an apparatus for making a cup of a surface protected paperboard which minimizes a number of perating steps necessary to seal the cup.

A still further object of the present invention resides in providing an apparatus for making a cup of a surface protected paperboard which minimizes total manufacturing costs.

Another object of the present invention resides in providing an apparatus for making a cup of a surface protected paperboard which ensures a continuous manufacturing operation.

These and other objects, features, and advantages of the present invention will become more apparent from the following description when taken in connection with the accompanying drawing which shows, for the purposes of illustration only, one embodiment in accordance with the present invention, and wherein.

Figure 1:
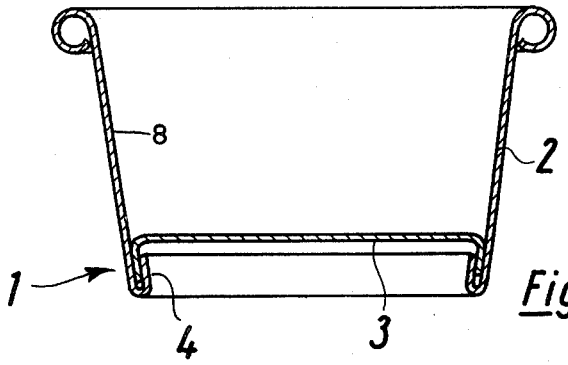
FIG. 1 is a cross sectional view of a paper cup produced in accordance with the present invention.

Referring now to the drawings wherein like reference numerals are used throughout the various views to designate like parts and, more particularly, to FIG. 1, according to this Figure, a cup 1 includes a cup wall 2 in which a bottom 3 is inserted, with at least an inner wall surface 8 of the cup 1 being provided with an inner coating or the like impervious to liquids. The bottom 3 of the cup 1 is bent downwardly in a zone of a sealing area 4 in such a manner that there is no internal open cutting edge.

Figure 2:
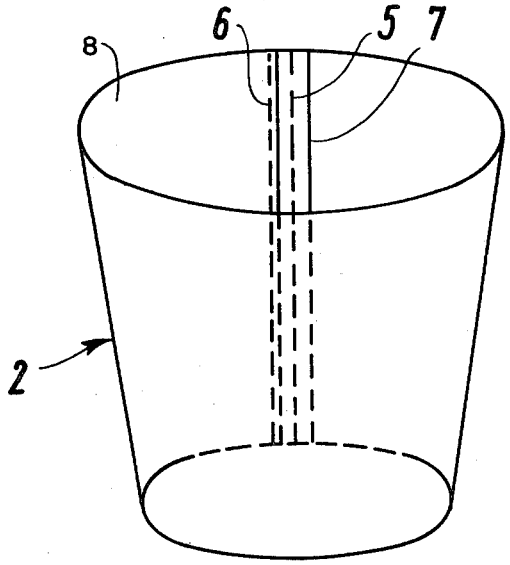
FIG. 2 is a perspective view of a blank forming a wall of the cup of FIG. 1 wound into a shell without a rolled rim and bottom.
Figure 3:
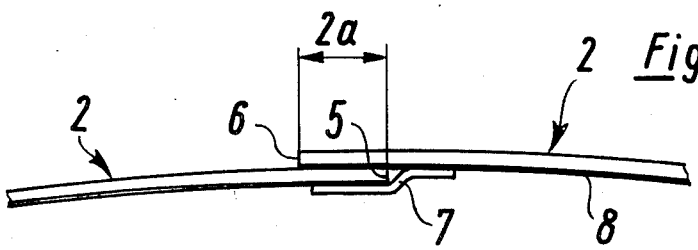
FIG. 3 is a top view on an enlarged scale of an overlaping zone of the cup wall of FIG. 2.

As shown most clearly in FIGS. 2 and 3, after a winding of the cup wall 2, an inner cutting edge 5 is produced which is not covered by the inner coating of the inner wall surface 8. The outer cutting edge 6 formed in an overlapping zone 2*a* does not present problems regarding sealing since the edge 6 does not come in contact with the contents of the cup. To seal the inner cutting edge, the cup wall 2 is covered in a zone of the cutting edge with a sealing strip 7 which is welded together with the two ends of the cup wall 2 on an inside of the cup.

The wall thickness in FIG. 3 is greatly exaggerated for the purposes of clarity and, in reality, one can assume that the sealing strip can be considered as a flatly lying strip without any bend and, it has been found under practical conditions, that the sealing strip 7 may be a relatively thin wall sealing strip.

Figure 4:
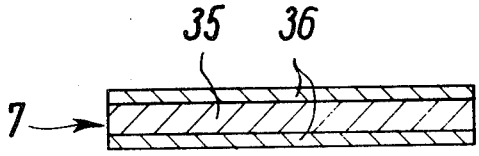
FIG. 4 is a cross sectional view, on an enlarged scale, of a portion of the sealing strip of the wall in FIG. 3.

FIG. 4 provides an enlarged cross sectional view of the sealing strip 7, an according to this Figure, the sealing strip 7 includes a support or substrate material 35 with outer layers disposed on respective sides of the material 35. The support material 35 is selected so that it is not as yet sealable at temperatures at which the overlapped ends 2*a* of the cup wall 2 are sealed together and only the outer layers of the sealing strip 7 are sealable at these operating temperatures. By means of the provision of a composite sealing strip 7, it is possible to provide a sealing strip 7 which does not shrink during a sealing operation.

Advantageously, the support material may, for example, consist of aluminum, with the outer layers being formed in a suitable synthetic resin. Alternatively, the support layer 35 as well as the outer layers 36, can all be of a synthetic resinous material, with the only consideration to be taken into account is that the support layer 35 has a higher sealing temperature. For this purpose, the support layer 35 may, for example, consist of a polyester; whereas, the outer layers 35 may be made of a polyethylene. With a sealing strip 7 constructed in this manner, it is also possible to dispense with the outer layer 36 located toward the inside of the cup, if the support material proper may come into contact with the subsequent contents of the cup without any misgivings or potential dangers. As can readily be appreciated, by dispensing with the outer layer 36 located toward the inside of the cup 1, it is possible to even further reduce the wall thickness in the overlapping zone 2*a*.

Figure 5:
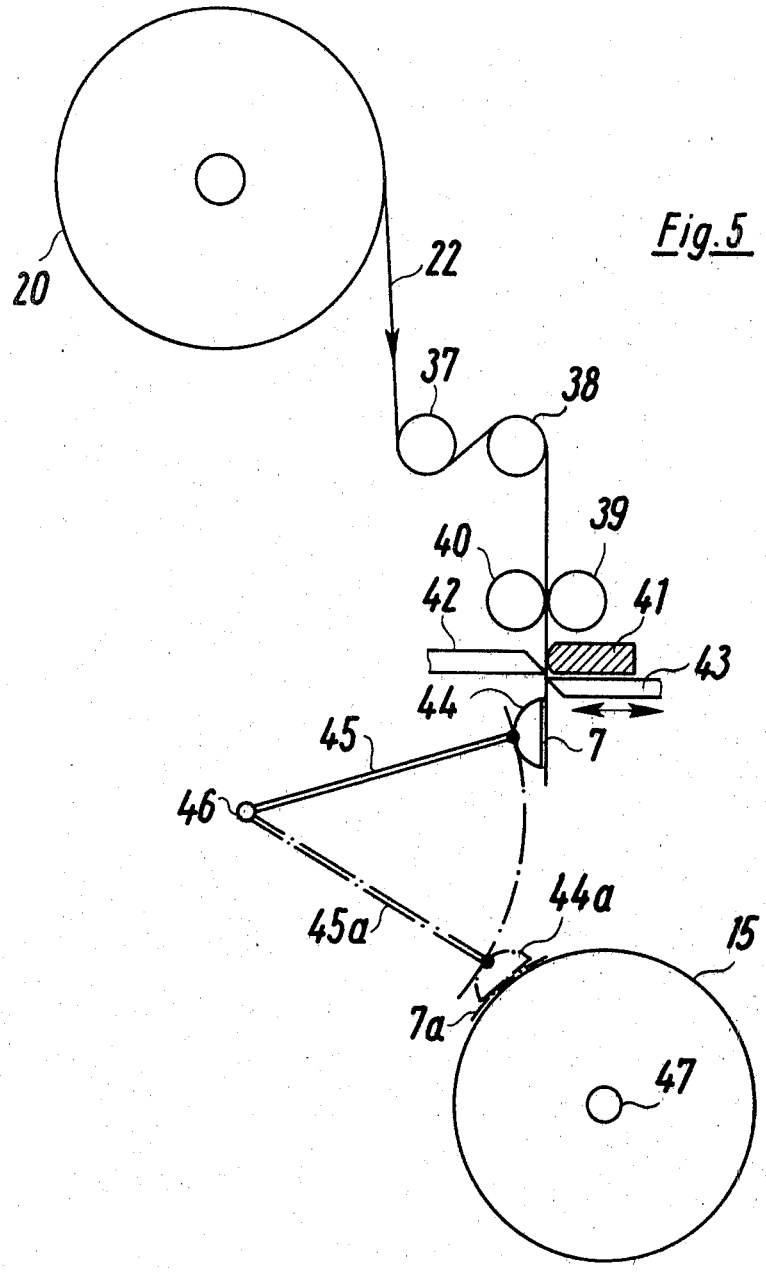
FIG. 5 is a partially schematic view of a means for positioning a sealing strip.

FIG. 5 provides an example of a feeding unit for the sealing strip 7 in an apparatus constructed in accordance with the present invention and, according to this figure, individual sealing strips 7 are severed from a continuous sheet 22 of a film which is wound on a storage reel 20. The film sheet 22 is fed in a direction of the arrow and is first directed or placed around two rolls 37, 38 of which, for example, the roll 37 may be fashioned as a so called dancer roll by means of which the feeding speed may be regulated and thus a longitudinal compensation can be obtained. The film sheet 22 is directed from the roll 38 to actual transport rolls 39, 40 which are suitably driven in rhythm or synchronism which may be effected by connecting the rolls 39, 40 to a crankdrive (not shown) so that the rolls 39, 40 execute in all cases only a revolution or rotation over a certain angluar amount and are then arrested for a short period of time. By virtue of this feeding or transporting operation, it is possible to obtain, in all cases, a sealing strip 7 having the required length.

The sealing strip 7 is cutoff from a free end of the length of the film sheet 22 by a cutting unit which, for example, may include a fixed cutting device associated with two blades 42, 43, with the blade 43 being movable in the direction illustrated by the double arrow in FIG. 5. The sealing strip 7 to be severed from the length of film sheet 22 is held, during the cutting or severing operation, by a suction cup 44 which is under a vacuum. The suction cup 44 is arranged at a lever 45 pivotable about a fixed axle 46. A vacuum line (not shown) passes through an interior of the lever 45 and through an interior of the axle 46 and is connected to a suitable vacuum source.

After the sealing strip 7 is severed from the film sheets 22, the lever 45 pivots about the axle 46 to a position 45*a* indicated in phantom lines, with the suction cup 44 then assuming the phantom line position 44*a* lying approximately tangentially to a periphery of a winding mandrel 15. The severed sealing strip designated 7*a*, is placed on the winding mandrel the arrangement of which will be described more fully hereinbelow. The winding mandrel is air permeable in a zone in which the sealing strip 7*a* is applied and, for this purpose, at least a portion of the winding mandrel is hollow, with a vacuum line 47 extending through the center axis of the winding mandrel 15 for communicating the hollow portion of the winding mandrel 15 with a source of vacuum (not shown).

Figure 6:
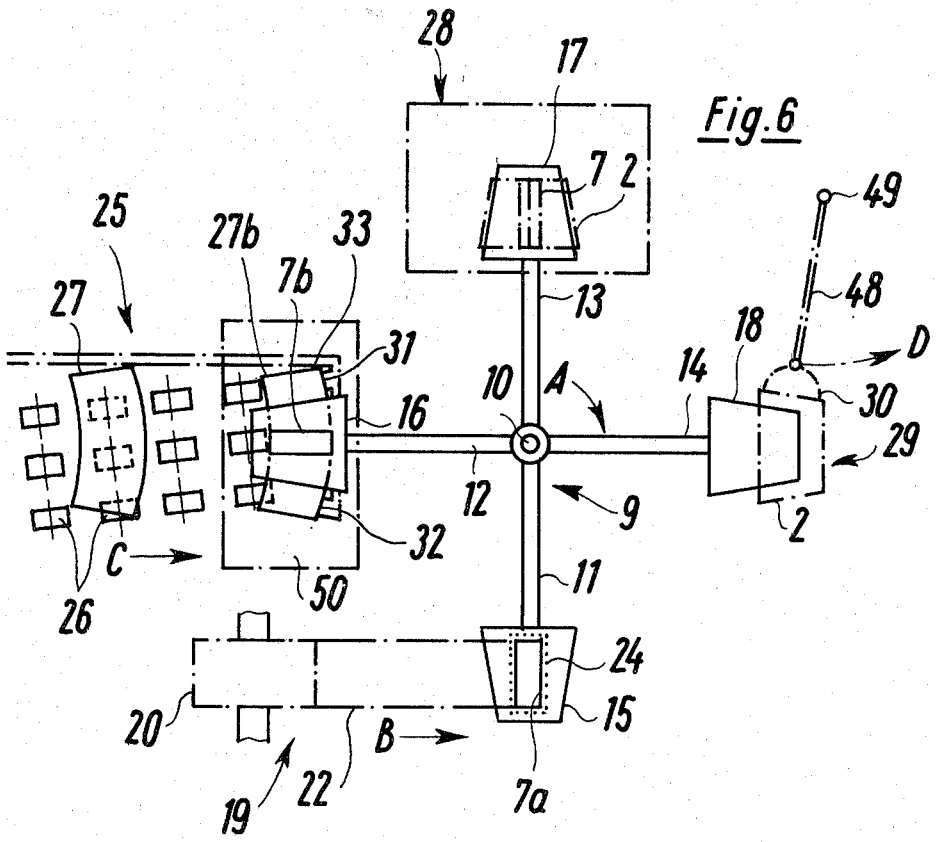
FIG. 6 is a partially schematic view of an apparatus for manufacturing the cup of the present invention with the aid of a winding star unit.

As shown in FIG. 6 the apparatus further includes a winding star unit or turrent head generally designated by the reference numeral 9 rotatable in synchronism about a vertical axle 10. The star unit includes at least four tool arms 11, 12, 13, 14 upon which are respectively attached a winding mandrel 15, 16, 17, 18. The star unit 9 is indexible in a direction of the arrow A so as to transport the respective mandrels 15, 16, 17, 18 between a positioning station generally designated by the reference numeral 19, blank feeding station generally designated by the reference numeral 25, welding station generally designated by the reference numeral 28, and removal station generally designated by the reference numeral 29.

In FIG. 6, the winding mandrel 15 is disposed in the positioning station 19 wherein a sealing strip is to be correlated thereto in a manner described hereinabove in connection with FIG. 5. For reasons of clarity, several details of FIG. 5 have been omitted from FIG. 6 and merely the storage reel 20 and film sheet 22 have been illustrated in FIG. 6. Accordingly, FIG. 6 provides an illustration of the condition of the winding mandrel 15 with the sealing strip 7*a* having been severed from the film sheet 22, supplied in a direction of the arrow B, and placed on the winding mandrel 15. The depositing of the sealing strip 7*a* on the winding mandrel 15 is made possible by virtue of the provision of one or more perforations 24 provided in the winding mandrels in a respective zone correlated to the accommodating of the sealing strip 7*a*. The perforations communicate with the hollow chamber within the respective mandrels, which chamber is connected to a vacuum line (not shown) extending through the arms of the star unit 9 and through the axle 10 to a vacuum source (not shown). It is also possible to provide an air permeable insert in the respective winding mandrels in place of the perforations 24.

After receiving the sealing strip 7*a*, the winding mandrel 15 of the winding star unit revolves further in the direction of the arrow A so as to assume a position in the blank feeding station 25 which, in FIG. 6, is occupied by the winding mandrel 16. The blank feeding station includes a winding station 50 in which the cup segments are wrapped about the winding mandrel located therein in a conventional manner and shaped into a cup shell. In FIG. 6, the sealing strip on the mandrel positioned in the blank feeding station is denoted by the reference numeral 7*b*. With the mandrel being advanced from the positioning station 19 to the blank feeding station, a new winding mandrel is at the same time moved into the positioning station 19 so as to already receive another sealing strip 7*a* in the positioning station 19.

The blank feeding station 25 includes a suitable conveyor or transporting means such as, for example, driven rollers 26 which feed or transport the cup segments or wall blanks 27, in a direction of the arrow C, into an end position at the winding station 50, wherein the respective cup segments 27 are then wound on the mandrel present in the winding station 50. Stops 31, 32 are provided for defining the end position at the winding station 50, with a lateral alignment of the cup segments or wall blanks 27 being accomplished by a lateral edge 33. Due to the fact that the rollers 26 are arranged at a slight inclination with respect to the lateral edge 33, the cup segments or wall blanks 27 can arrive accurately and assume a position designated 27*b*.

In this connection, the blank 27*b* is disposed beneath the winding mandrel 16 and is conventionally wrapped around the winding mandrel by brush-like tools (not shown). In this procedure, the sealing strip 7*b* comes to lie on an inside of the cup shell in a manner illustrated more clearly in FIGS. 2 and 3. In this position, the blank 27*b* is likewise held by the suction or vacuum device associated with the respective mandrels. After the cup shell is wound in the winding station 50, the star unit 9 is once again indexed in the direction of the arrow A so that the winding mandrel from the winding station 50 would then assume the position of the winding mandrel 17 located in the welding station 28 indicated in phantom lines.

On the winding mandrel 17, a longitudinal seam of the cup shell formed by the overlapping ends are closed or sealed in a conventional sealing step. For clarity, the cup wall 2 in FIG. 6 is indicated in phantom lines. At the welding station, the sealing strip 7 is simultaneously welded into place with the closing of the wall 2 by, for example, a so-called ultrasonic welding method.

After the welding operation, the star unit 9 is once again indexed in the direction of the arrow A so that the winding mandrel 17 arrives in the position occupied by the winding mandrel 18 in FIG. 6, namely, in the removal station 29. In station 29, the finished wall 20*a* is entrained by, for example, a pivotally mounted suction cup arrangement 30 seated on a lever 48 and pivotable about the axle 49. The suction cup 30 pulls the wall 2 off the winding mandrel in a direction of the arrow D, and the sealed cup shell is then transported for further processing. More particularly, the cup shell is then fed to a further processing station (not shown) wherein the cup bottom 3 is inserted into a shell in a conventional manner. The individual operating steps described hereinabove in cooperation with the winding star unit, with the exception of the operating steps carried out in the positioning station, may be effected in a conventional manner. In this connection, provision may be made that further winding mandrels may be provided in order to enable additional working or processing steps on the cups. For this purpose, the star unit 9 may be provided with additional tool arms for accommodating the further mandrels. By virtue of the use of a star unit 9, the process of the invention for provision of sealing strips 7 may be realized in an expecially simple manner and it is merely necessary to fashion the respective winding mandrels so as to be air permeable in a suitable manner and to connect the respective mandrels to a vacuum device so that the respective sealing strips 7, prior to a feeding of the wall blank or cup segment 27, is in all cases positioned correctly on the respective winding mandrels. As can readily be appreciated, it is also feasible to provide for a different positioning. With the arrangement of the present invention, additional working steps are eliminated since the sealing of the cup wall 2 as well as the provision of the sealing strip 7 take place in a single welding operation thereby enabling a cup to be manufactured at an especially low cost.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. An apparatus for producing a paper cup, the apparatus comprising at least one winding mandrel means for winding a wall blank into a wound cup shell having a seam formed by overlapping ends of the wall blank, means for sealing the wall blank in an interior of the cup in an area of the overlapping ends, and means for inserting a cup bottom into the cup shell, characterized in that means are provided for positioning a protective sealing strip on the at least one winding mandrel means prior to disposing the wall blank on the winding mandrel means so that a sealing of the overlapping ends is obtained by the sealing strip.

2. An apparatus according to claim 1, characterized in that a plurality of winding mandrel means are provided, means are provided for sequentially indexing the respective mandrel means between the positioning means, the winding means, the sealing means, and the bottom inserting means.

3. An apparatus for producing a paper cup, the apparatus comprising at least one mandrel means for winding a wall blank into a wound cup shell having a seam formed by overlapping ends of the wall blank, means for sealing the wall blank in an interior of the cup in an area of the overlapping ends, and means for inserting a cup bottom into the cup shell, characterized in that means are provided for positioning a protective sealing strip on the at least one winding mandrel means prior to a winding of the wall blank, said positioning means includes a suction means, an arm means carrying the suction means, and means for pivotally mounting the arm means so that the suction means has a path of motion approximately tangential to an outer peripheral surface of the at least one mandrel means.

4. An apparatus according to claim 3, characterized in that means are provided in the at least one winding mandrel means for holding the sealing strip thereon.

5. An apparatus according to claim 4, characterized in that at least a portion of the at least one winding mandrel means is hollow, means are provided for communicating the hollow portion with a vaccum source, and in that the holding means includes a permeable wall portion provided in the outer peripheral surface of the at least one mandrel means.

6. An apparatus according to claim 5, characterized in that the permeable wall portion is provided with at least perforation communicating with the hollow portion of the at least one mandrel means.

7. An apparatus according to one of claims 1, 3, 4, 5, or 6, characterized in that means are provided for sequentially indexing the at least one winding mandrel means between the positioning means, the winding means, the sealing means, and the bottom inserting means.

8. An apparatus according to claim 7, characterized in that the positioning means includes a means for accommodating a length of sheeting forming the protective strip, and means for severing a length of sheeting into protective sealing strips of predetermined lengths.

9. An apparatus according to claim 8, characterized in that the sealing means is a welding station for ultrasonic welding.

10. An apparatus for producing a paper cup, the apparatus comprising a plurality of winding mandrel means for winding a wall blank into a wound cup shell having a seam formed by overlapping ends of the wall blank, means for sealing the wall blank in an interior of the cup in an area of the overlapping ends, and means for inserting a cup bottom into the cup shell, characterized in that means are provided for positioning a protective sealing strip on the respective winding mandrel means prior to a winding of the wall blank, said positioning means includes a suction means, and an arm means carrying the suction means, and means for pivotally mounting the arm means so that the suction means has a path of motion approximately tangential to an outer peripheral surface of a winding mandrel means disposed at the positioning means, and in that means are provided for sequentially indexing the respective mandrel means between the positioning means, the winding means, the sealing means, and the bottom inserting means.

11. An apparatus according to claim 10, characterized in that means are provided in each of the mandrel means for holding a sealing strip thereon.

12. An apparatus according to claim 11, characterized in that the positioning means includes a means accommodating a length of sheeting forming the protective strip, and means for severing a length of sheeting into protective sealing strips of a predetermined length.

13. An apparatus according to claim 12, characterized in that the sealing means is a welding station for ultrasonic welding.

* * * * *